US008047145B2

(12) United States Patent
Gretta et al.

(10) Patent No.: US 8,047,145 B2
(45) Date of Patent: Nov. 1, 2011

(54) AMMONIA VAPORIZATION SYSTEM USING NON-FLUE GAS INTERMEDIATE HEAT TRANSFER MEDIUM

(75) Inventors: William Gretta, Clinton, NJ (US); Eric Pear, Bridewater, NJ (US); Dileep Karmarkar, Warren, NJ (US)

(73) Assignee: Hitachi Power Systems America, Ltd, Basking Ridge, NJ (US)

( * ) Notice: Subject to any disclaimer, the term of this patent is extended or adjusted under 35 U.S.C. 154(b) by 1290 days.

(21) Appl. No.: 11/677,036

(22) Filed: Feb. 20, 2007

(65) Prior Publication Data

US 2008/0196763 A1 Aug. 21, 2008

(51) Int. Cl.
*F23J 15/00* (2006.01)
*F23L 7/00* (2006.01)

(52) U.S. Cl. ..... 110/302; 110/203; 165/140; 122/31.1; 122/32

(58) Field of Classification Search ..... 110/297, 110/301, 302, 304, 203; 122/31.1, 32; 165/104.11, 165/104.34, 140; 376/210, 211, 298, 299, 376/404, 405
See application file for complete search history.

(56) References Cited

U.S. PATENT DOCUMENTS

| | | | |
|---|---|---|---|
| 3,344,585 | A | 10/1967 | Hollowell |
| 4,058,375 | A | 11/1977 | Lawrence |
| 4,115,515 | A | 9/1978 | Tenner et al. |
| 4,911,900 | A | 3/1990 | Horch et al. |
| 5,069,886 | A | 12/1991 | Frey et al. |
| 5,098,680 | A | 3/1992 | Fellows et al. |
| 5,282,355 | A | 2/1994 | Yamaguchi |
| 5,296,206 | A | 3/1994 | Cho et al. |
| 5,437,851 | A | 8/1995 | MacInnis |
| 5,525,317 | A | 6/1996 | Bhat et al. |
| 5,820,838 | A | 10/1998 | Tsuo et al. |
| 6,019,068 | A | 2/2000 | Tsuo et al. |
| 6,146,605 | A | 11/2000 | Spokoyny |
| 6,264,905 | B1 | 7/2001 | Spokoyny |
| 6,325,985 | B1 | 12/2001 | Koshinen et al. |
| 6,403,046 | B1 | 6/2002 | Spokoyny |
| 6,436,359 | B1 | 8/2002 | Spencer, III et al. |
| 6,599,119 | B1 | 7/2003 | Wood et al. |
| 6,601,385 | B2 | 8/2003 | Verdegan et al. |
| 6,616,901 | B1 | 9/2003 | Lagana et al. |
| 6,620,393 | B2 | 9/2003 | Spokoyny |
| 6,694,900 | B2 | 2/2004 | Lissianski et al. |
| 7,069,715 | B1 | 7/2006 | Childers |
| 7,090,810 | B2 | 8/2006 | Sun et al. |
| 2004/0120872 | A1 | 6/2004 | Fan et al. |
| 2004/0197251 | A1 | 10/2004 | Williamson |
| 2006/0242970 | A1 | 11/2006 | Yang et al. |

*Primary Examiner* — Kenneth Rinehart
*Assistant Examiner* — David J Laux
(74) *Attorney, Agent, or Firm* — Straub & Pokotylo; Michael P. Straub; Ronald P. Straub

(57) ABSTRACT

Methods and apparatus for generating a vapor to be injected into a flue gas stream are described. The apparatus includes a fluid vaporization and injection assembly including an input for receiving a non-flue gas, e.g., clean, fluid heat transfer medium, e.g., air; a first sealed coil having an input and an output through which a fluid, such as ammonia, to be vaporized is passed; and a second sealed coil having an input and an output through which a heated second fluid, such as water or steam, is passed. The second sealed coil is arranged to transfer heat from the heated second fluid to the non-flue gas fluid heat transfer medium. The first sealed coil is arranged to absorb heat from the non-flue gas fluid heat transfer medium. An injection unit is coupled to an output of the first sealed coil for injecting the vaporized fluid into a flue gas stream.

28 Claims, 6 Drawing Sheets

AMMONIA VAPORIZER COIL
CROSS SECTION

AMMONIA VAPORIZATION SYSTEM USING NON-FLUE GAS INTERMEDIATE HEAT TRANSFER MEDIUM

RELATED APPLICATIONS

The present application describes subject matter which is related to and/or can be used with the system described in U.S. patent application Ser. No. 11/677,038 titled "SEPARATION OF AQUEOUS AMMONIA COMPONENTS FOR $NO_X$ REDUCTION" which is hereby expressly incorporated by reference and which has the same inventors and is being filed on the same date as the present application.

FIELD OF THE INVENTION

This invention relates to vaporization systems including, for example, ammonia vaporization systems used for injection of ammonia into flue gas streams.

BACKGROUND OF INVENTION

One of the byproducts of power plants and turbine engines is exhaust gas, commonly known as flue gas. This gas may contain components which are harmful to the environment, such as oxides of nitrogen ($NO_x$). The production of $NO_x$ can occur when fossil fuels are combusted, such as in turbines, refinery heaters, steam boilers, etc. Such fuels include coal, oil, natural gas, waste product such as municipal solid waste, petroleum coke, and other carbon-based materials. It is beneficial to the environment to control the levels of $NO_x$ released into the atmosphere by burning such fuels.

One common approach to handling this situation is to inject a reducing gas into the flue gas stream, which will remove $NO_x$ from the stream. One common method is a selective catalytic reduction (SCR) process which involves the injection of ammonia ($NH_3$) into the flue gas stream and then passing the resultant flue gas over a catalyst. The flue gas and the ammonia regent travel through a catalytic converter that facilitates the breakdown of $NO_x$ into nitrogen ($N_2$), oxygen ($O_2$), and water, which are not harmful to the atmosphere.

One known method for generating ammonia vapor uses anhydrous ammonia, which is evaporated with either a direct electric heat source or with steam coils directly supplying the heat to the ammonia. The vaporized ammonia is then diluted with air in order to provide an adequate mass necessary to distribute the ammonia reagent evenly over a large ductwork cross-section. A disadvantage of such a system is the need for maintenance of the electric or steam coils as they are in direct contact with the anhydrous ammonia. Further, any breach of the steam coil could result in ammonia contamination of the steam system.

Another known method of generating ammonia vapor is to use a selective non-catalytic reduction process (SNCR) wherein a liquid aqueous ammonia derivative is sprayed into a high temperature region of the furnace in order to accomplish $NO_x$ reduction. In some systems the energy from the flue gas is used to accomplish the phase change. A major problem associated with this method of relying on the flue gas to supply the heat is that a long time is required in the hot region in order to vaporize the water and ammonia and for the reaction with the $NO_X$.

Another known method is to vaporize aqueous ammonia, and then inject the vapor into the flue gas stream at a location upstream of the SCR reactor. A known approach to heating the aqueous ammonia is to use a diverted portion of flue gas, to heat up the aqueous ammonia. A problem with this approach is that everything that the flue gas comes in contact with is contaminated, from such contaminates in the flue gas as dust, ash, and sulfur oxides. In addition, the amount of heat available for vaporization is a function of the flue gas temperature making control of vaporization more difficult than where the heat source can be readily controlled to supply differing amounts of heat depending on sensed operating conditions In view of the above discussion, it should be appreciated that there is a need for new and improved ways of preparing an ammonia regent for injection into the flue gas stream of a furnace in order to reduce the level of $NO_x$ in the flue gas.

SUMMARY OF THE INVENTION

The methods and apparatus of the present invention allow for a cleaner process of vaporizing ammonia than various prior art systems by utilizing an intermediate fluid heat transfer medium, e.g., air, to conduct heat between an initial heat source such as a heating fluid, e.g., hot water or steam, and the liquid ammonia to be vaporized. One advantage of the design over various known systems is that neither a leak of the initial heating fluid water or steam, nor a leak of the ammonia, will contaminate the other since both are included in coils over which the heat transfer medium, e.g., air, passes. As should be appreciated a leak of either the ammonia or the heating fluid water can be easier to deal with and clean up than a leak of one into the other.

In addition to maintenance advantages, the inventive process and system allow for greater control of the ammonia heating/vaporization process, allowing for a more efficient and controllable system of injecting the vaporized ammonia into a flue gas stream. Also, the ammonia vapor resulting from this inventive process and apparatus may have a lower water content than when some known approaches are used; thereby potentially causing less corrosion of the flue and associated equipment.

In some embodiments, an ammonia vapor to be injected into a flue gas stream is generated by an apparatus which utilizes a non-flue gas fluid heat transfer medium. The apparatus includes a first sealed coil having an input for receiving ammonia to be vaporized and an output for delivering and injecting the resultant ammonia vapor for delivery into a flue gas stream. The apparatus also includes a second sealed coil containing a heated medium, such as water, wherein the second sealed coil is arranged to heat the non-flue gas fluid heat transfer medium, and the first sealed coil is arranged to absorb heat from the non-flue gas fluid heat transfer medium.

In some exemplary embodiments a blower is used to force the non-flue gas fluid heat transfer medium through and around the second sealed coil and then the first sealed coil thereby transferring heat from second coil to the first through the use of the fluid heat transfer medium which may be e.g. air. The heated medium in the second coil can advantageously be made to flow through the coil, so that the medium can be continuously reheated, or new heated medium introduced to the coil. The flow of the fluid heat transfer medium over and through the first and second coils can be controlled hereby providing a level of heat control which can be in addition to the control by adjusting the temperature and/or amount of fluid passing through the second coil. All or a portion of the non-flue gas fluid heat transfer medium, e.g., heated air, may be mixed with the ammonia vapor prior to injection of the generated vapor into the flue gas stream. Thus, in some embodiments, the non-flue gas fluid heat transfer medium is used to dilute and carry the generated ammonia vapor which is then injected into the flue gas. Alternatively, or in addition to using some of the non-flue gas fluid heat transfer medium to dilute ammonia vapor, all or a portion of the non-flue gas fluid heat transfer medium can be re-circulated.

In some but not necessarily all embodiments of the present invention, the flue gas is monitored for such attributes as NOx concentrations, flow rate, and temperature, with one or more control modules utilizing this input to control the amount of vaporized ammonia injected into the flue gas stream. In some exemplary embodiments a boiler is placed in the furnace that generates the flue gas, to produce steam to be passed through the second coil to serve as the heat source for the ammonia vaporization process.

Additional features and benefits of the present invention are discussed in the detailed description which follows.

DETAILED DESCRIPTION

The methods and apparatus of the present invention for vaporizing a fluid, e.g., ammonia, and injecting the vapor into a flue gas stream can be used with a wide range of furnace environments. For example the invention can be used with power plants, refineries, or other instances of the use of turbine engines, heaters, steam boilers, etc.

Figure 1:
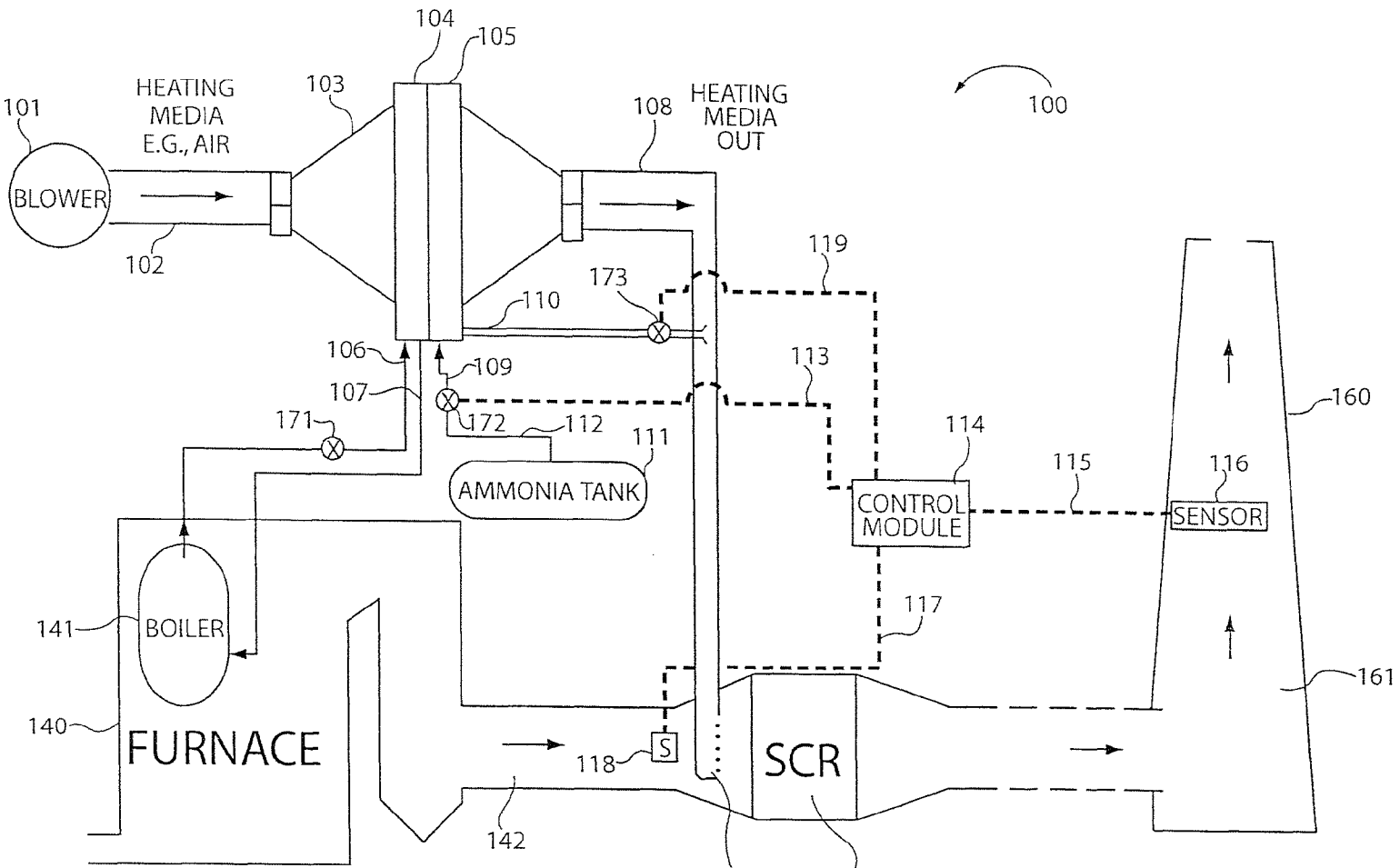
FIG. 1 illustrates a generating system including apparatus in accordance with one exemplary embodiment of the present invention.

FIG. 1 illustrates an exemplary system 100 implemented in accordance with the present invention, e.g., a power plant, which comprises a furnace, flue stack, SCR apparatus, and an ammonia vaporizing assembly.

The ammonia vaporizing assembly includes ammonia from ammonia tank 111, which is transported by pipe 112 through valve 172 and inlet 109 into a sealed coil 105. The ammonia is advantageously in a liquid state, with little or no water mixed in. However, the ammonia could be in any state, including an aqueous solution state with varying amounts of water, or could be anhydrous ammonia. Also, other substances, such as methane, could be used in place of ammonia. Boiler 141 heats water in pipe 106 (producing hot water or steam) which flows through valve 171 into sealed coil 104. The return end of coil 104 contains water which has been cooled as a result of heat transfer to the heat transfer medium while passing through coil 104 back to boiler 141 via pipe 107, to be reheated and re-introduced into pipe 106.

Coil 104 and coil 105 make contact with, e.g., are surrounded by, a heat transfer media, such as air. Alternatively, a substantially inert gas could be substituted for the air. Blower 101 pushes the air through inlet 102 into housing 103 which directs the air flow over and around coils 104 and 105. The rate at which the blower spins and/or the amount of time the blower blows can, and in some embodiments is, controlled by control module 114 which is responsive to one or more sensor inputs in determining how to control the blower. When the air flows around coil 104 which contains hot water, steam, or other heating media, the air is heated. The heated air is then directed by housing 103 to pass over and around coil 105, such that liquid ammonia flowing through coil 105 is heated by the air before it exits through pipe 110, through valve 173 into injector ports 130 in flue 142, such that the injected vaporized ammonia mixes with the flue gas in flue 142 before reaching selective catalytic reduction (SCR) 150. The injection ports maybe implemented, for example, as holes in one or more pipes. The ports are used to inject the vaporized fluid which may have been mixed with some or all of the heat transfer media, e.g., air. The valve 173 can be used to vary the amount of vaporized ammonia delivered through the ports 130. Through the use of the heat transfer media, the liquid ammonia is heated without coming in direct contact with the water or steam, or with the coil holding the water or steam. By controlling the blower, the amount of air passing through the housing 103 and thus the rate of heat transfer can be controlled. In addition, the amount of heat transfer can also be controlled by the control module 114 regulating the amount, rate and/or temperature of the heating fluid passing through coil 104. Thus, through a combination of controlling the heating fluid passing through coil 104 and/or the air passing over and through coils 104 and 105, increased control over the amount of heat supplied to the ammonia to be vaporized can be achieved.

Because the heated air is not imported from the flue to heat the air 105, i.e., non-flue gas is used, the entire vaporizing assembly remains relatively clean, unlike prior art apparatus which were exposed to flue gas and its contaminates. However, in some embodiment's flue gas may be used to provide heat to the air prior to it being passed through the coils. The depicted arrangement of elements reduces the maintenance that would be required if the heating elements and ammonia were in direct contact. It should be appreciated that it may be possible to mix a small amount of flu gas with non-flue gas heat transfer medium providing some heat while relying on the non-flue gas component as the primary heat transfer medium between the two coils. Accordingly, introducing some flue gas into the non-flue gas heat transfer medium, while reducing the cleanliness of the system, still offers significant advantages over systems which do not use a non-flue gas heat transfer medium since the concentration of contaminants may be greatly reduced as compared to systems which primarily use flue gas to heat the ammonia.

The heated air in housing 103 is expelled out of exhaust 108. In some embodiments, as shown in FIG. 1, the heat transfer media, e.g., air, expelled out exhaust 108 is mixed with the ammonia vapor prior to injection of the ammonia vapor and heat transfer media, e.g., air, into the flue gas stream. In such an approach, the heated air serves to dilute and carry the ammonia vapor which is injected into the flue gas stream. Alternatively all or some of the heat transfer media expelled out of exhaust 108 can be returned to air inlet 102, expelled to the atmosphere, or used for some other beneficial purpose.

Boiler 141 is positioned in furnace 140 such that furnace 140 provides heat to boiler 141, as well as heat for the primary purpose of the power plant 100. The resultant combustion gas from the furnace is directed by flue 142 to injector ports 130. After the $NO_x$ in the flue gas 161 has been converted to benign elements by the ammonia vapor injected by injector ports 130 and SCR 150, it is released to the atmosphere by stack 160.

Control module 114 may be connected to various sensors. The control module 114 may be implemented as a computer device which implements one or more control routines which may be implemented in software. The control module 114, in some embodiments, is coupled to and interacts with, a power plant control system. The various sensors coupled to control module 114 may include, for example, sensor 118. Sensor 118 is positioned in the flue at a point before where the ammonia vapor is introduced into the flue gas and is connected to control module 114 via link 117, and can determine such things as the concentration of $NO_x$ gases in the flue at that point, the rate of flow of the flue gas, or the temperature of the flue gas at that point.

Also, control module 114 is shown linked via link 115 to sensor 116 in stack 160. From this sensor, a determination can be made as to the level of $NO_x$ remaining in the flue gas just prior to leaving stack 160. Although not shown, other sensors could signal control module 114 the temperature of the water in coil 104, the temperature of the ammonia in pipe 110, etc.

From these or other similar inputs, control module 114 can operate valve 173 via link 119 to control the output of ammonia vapor reaching injector ports 130. Also, control module 114 can operate valve 172 over link 113 to control the amount of liquid ammonia regent feeding into coil 105. Although not shown, control module 114 could be designed to control valve 171 to regulate the amount of hot water entering coil 104. Another example is to control blower 101 to control the amount of air flowing over coils 104 and 105. Other control functions could be controlled by control module 114, or similar devices.

Figure 2:
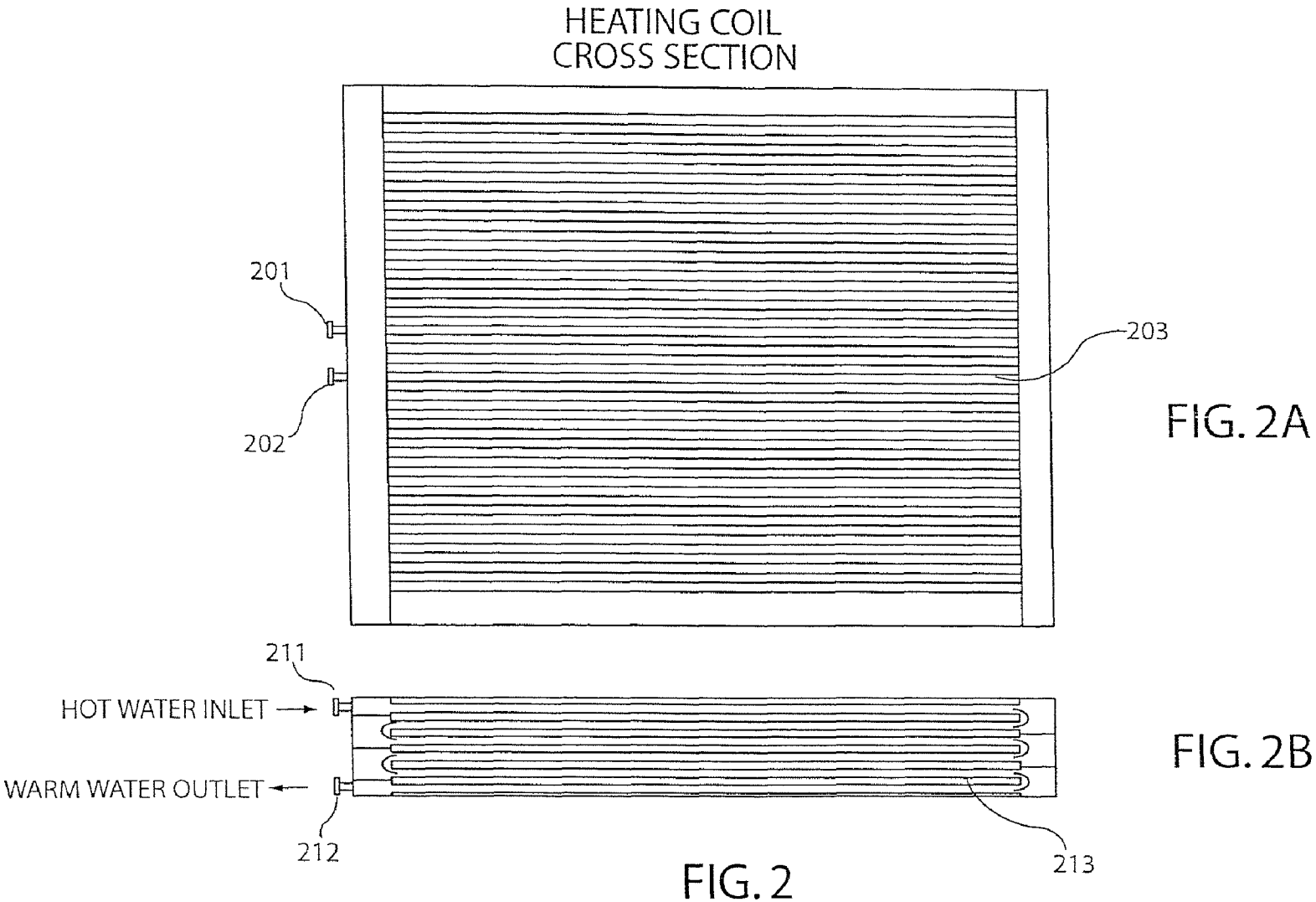
FIGS. 2A and 2B illustrate side and top views, respectively, of an exemplary heating coil implemented in accordance with the present invention.

FIG. 2A and FIG. 2B show two cross-sectional views, a side view and a top view, respectively, of the sealed heating coil 104 of FIG. 1. The hot water from boiler 141 of FIG. 1 enters through inlet 201. It then passes through the coil windings 203 and exits through outlet 202.

Figure 3A:
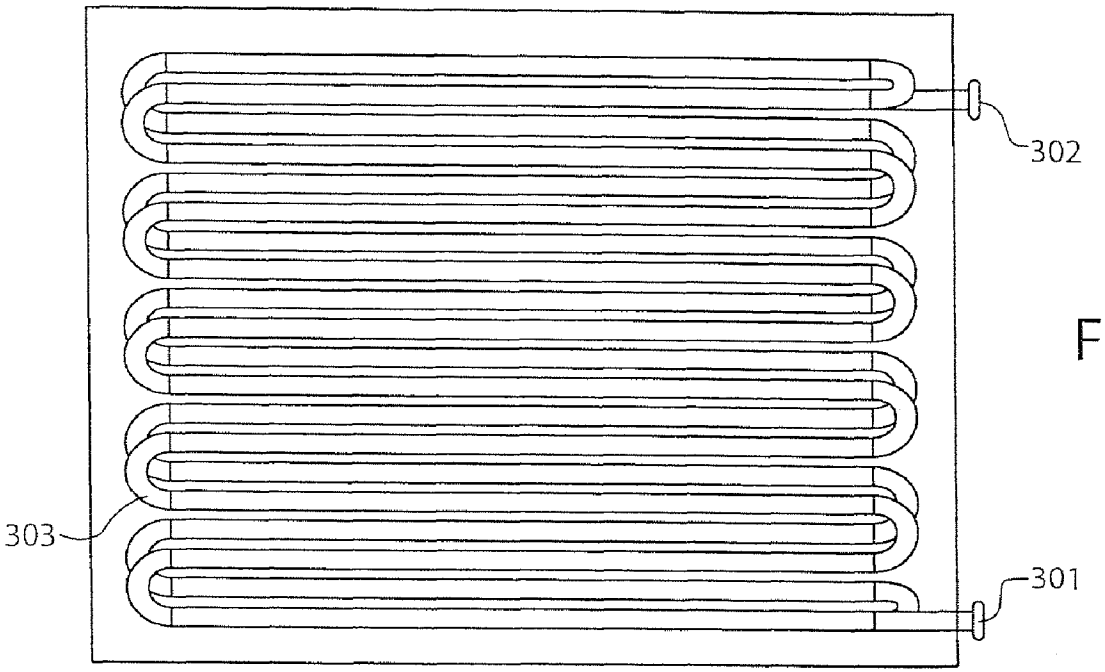
FIGS. 3A and 3B illustrate side and top views, respectively, of an exemplary ammonia vaporizer coil implemented in accordance with the present invention.
Figure 3B:
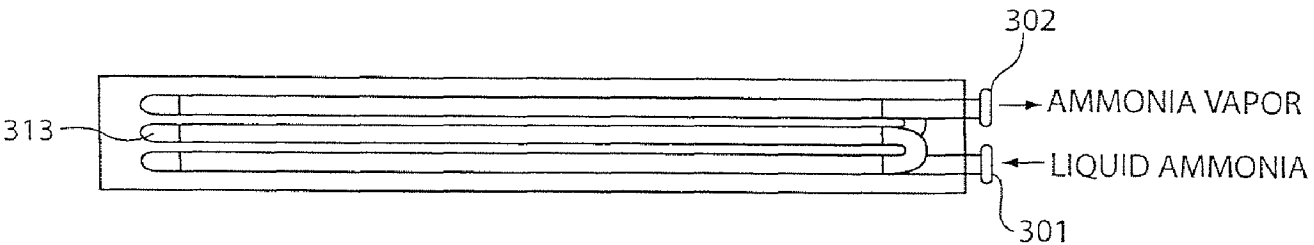

FIGS. 3A and 3B show two cross-sectional views, a side view and a top view, respectively, of the ammonia vaporizer coil 105 of FIG. 1. The liquid ammonia from ammonia tank 111 of FIG. 1 enters through inlet 301. It then passes through the coil windings 303 and exits through outlet 302 as ammonia vapor.

Figure 4:
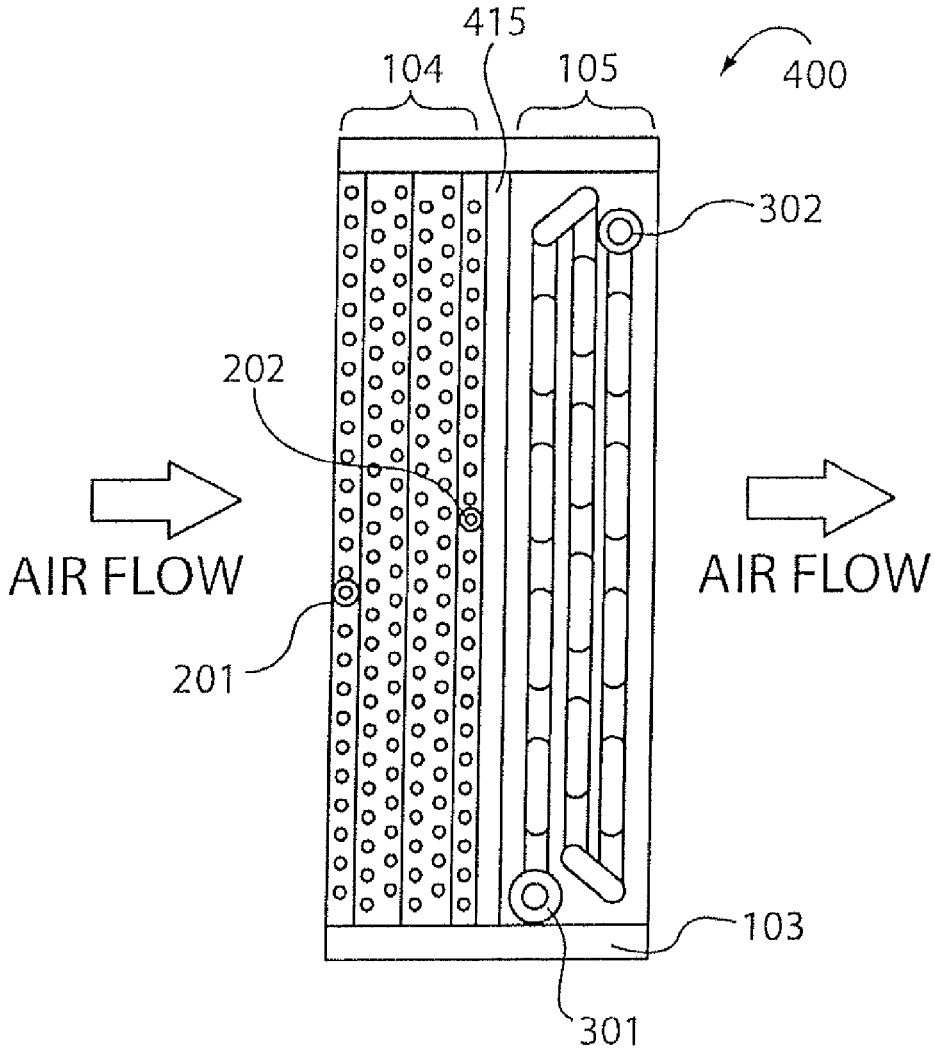
FIG. 4 illustrates an exemplary heating coil and an exemplary ammonia vaporizer coil, with associated non-flue gas fluid heat transfer medium, e.g., air, implemented in accordance with the present invention.

FIG. 4 shows a top view of coils 104 and 105 of FIG. 1, as arranged in housing 103, with the air flow from blower 101 of FIG. 1 shown moving from left to right. Hot water inlet 201 and hot water outlet 202 which correspond to reference numbers 201 and 202 are shown. Liquid ammonia inlet 301 and ammonia vapor outlet 302 are shown, in coil 105. The air flow first flows around the individual tubes of coil 104, wherein the air is heated. This heated air then flows around the individual tubes of coil 105, wherein the heated air heats the ammonia in coil 105, causing the ammonia to vaporize. Again, in this way, the ammonia does not come in contact with either the water or steam in coil 104, nor does it come in contact with the metal of coil 104 itself. The moving air thus serves as an intermediate heat transfer fluid. Note that a gap 415 is shown between coils 104, 105. This gap, which may be, e.g., one or two inches or some other distance, allows the coils 104, 105 to be removed and inserted into the housing 103 separately while also allowing for the coils 104, 105 to expand and contract without rubbing against each other.

Figure 5:
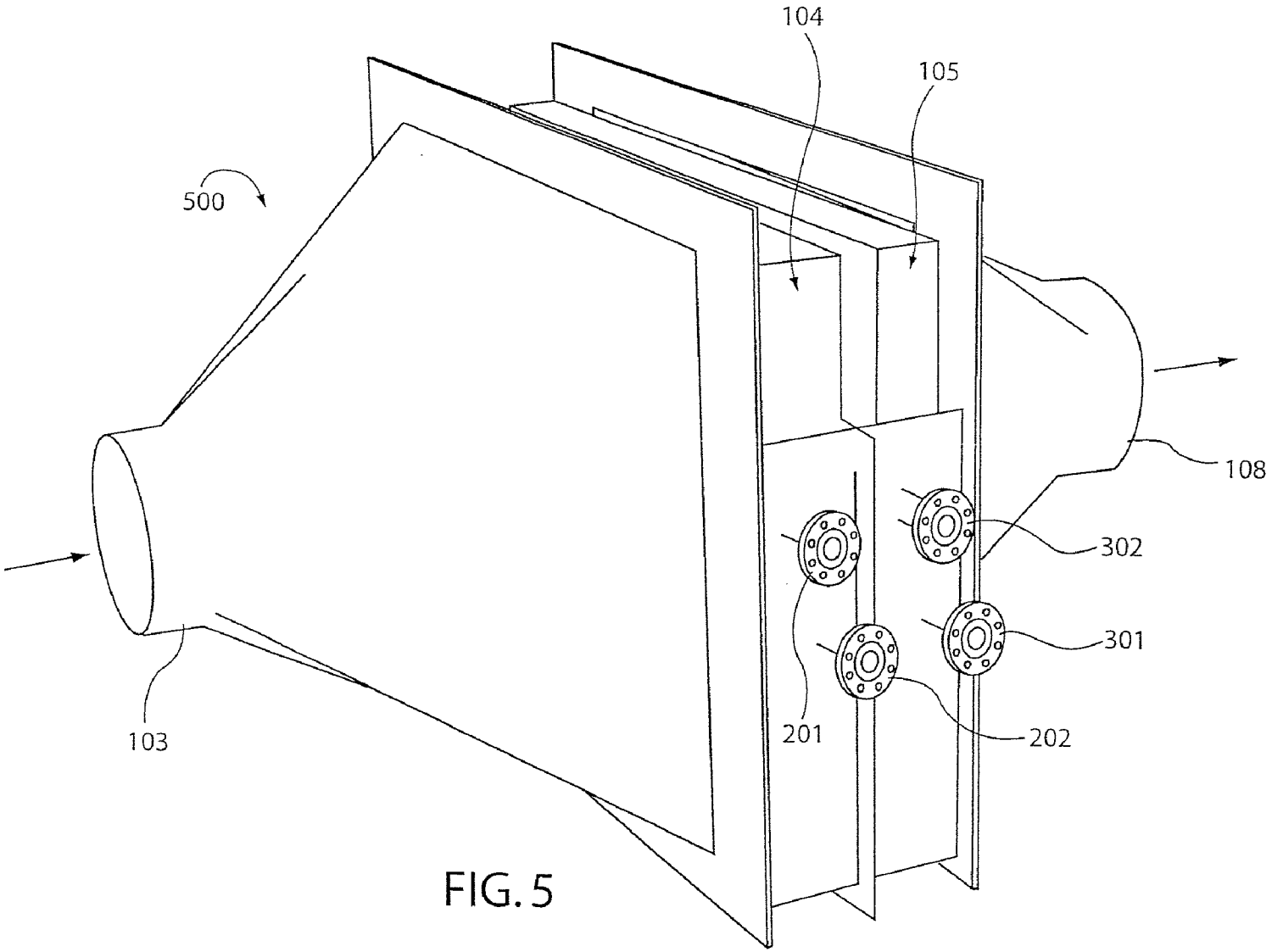
FIG. 5 illustrates an exemplary structure for passing non-flue gas fluid heat transfer medium over an exemplary heating coil and an exemplary ammonia vaporizer coil implemented in accordance with the present invention.

FIG. 5 shows an angled view of the outside of the an exemplary inventive vaporizer apparatus 500 which may be used as a vaporizer assembly which includes housing 103, and coils 104, 105 shown in FIG. 1. Housing 103 directs the flow of air over and around the coils of heating coil 104, with the hot water inlet 201 and the water outlet 202 as shown. Next, the heated air directed by housing 103 passes over and around ammonia coil 105 with liquid ammonia input 301 and ammonia vapor output 302 as shown. The heated air then passes out of housing exhaust outlet 108, for further use or discharge to the atmosphere as described previously.

Figure 6:
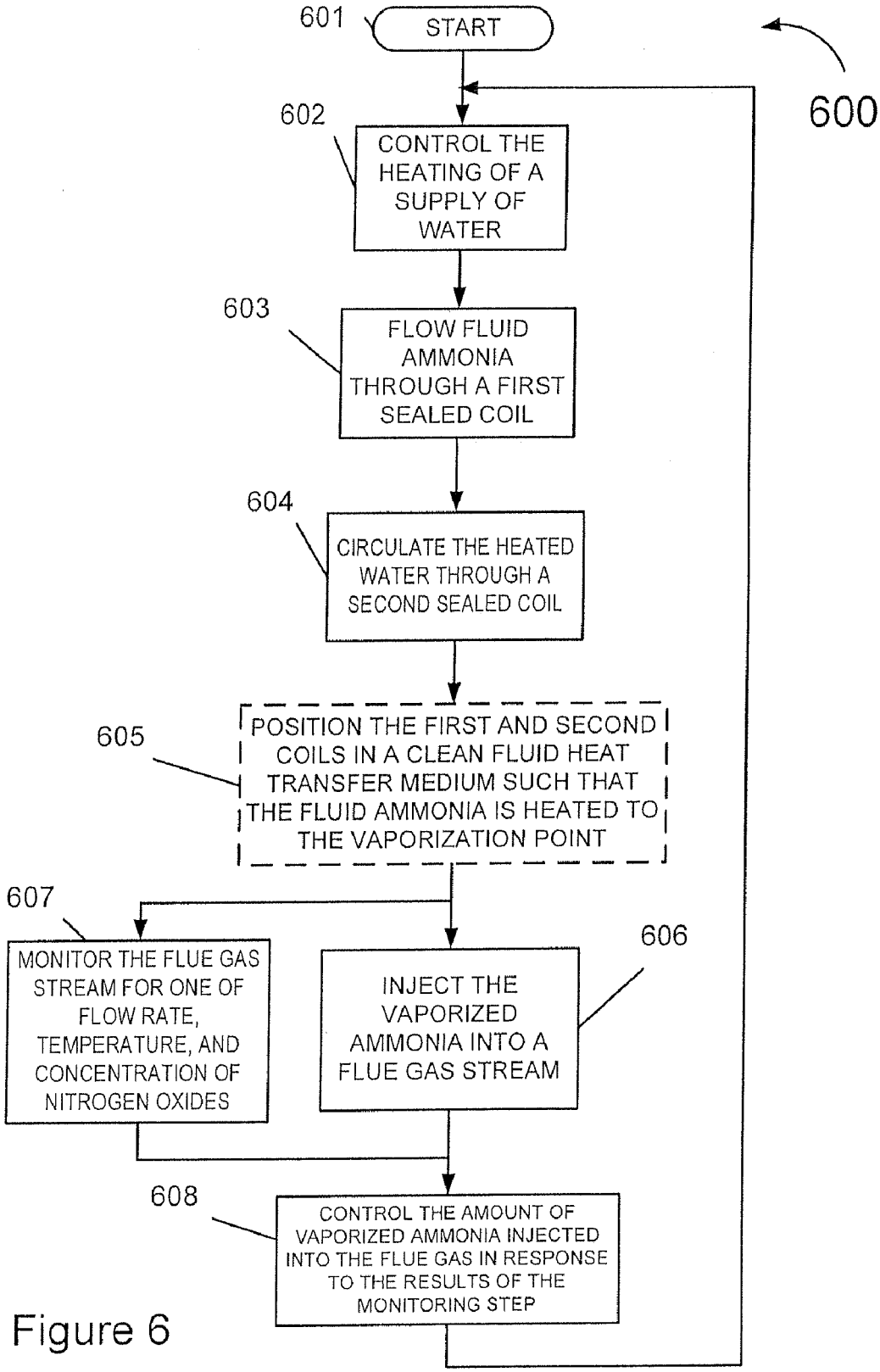
FIG. 6 is a flow diagram illustrating steps associated with practicing the invention.

FIG. 6 shows the steps of a method 600 that is implemented in some exemplary embodiments of the present invention. The method starts at step 601, and at step 602 the control module 114 and/or another control device controls the heating of a supply of water. The heating of the water performed in accordance with the invention could be via a boiler, or some other heating method. Next, in step 603, fluid ammonia is made to flow through a first sealed coil, e.g., coil 105.

Next, in step 604, the heated water is circulated through a second sealed coil, e.g., coil 104. The first and second coils are positioned in step 605 in a non-flue gas fluid heat transfer medium (such as air) such that the fluid ammonia is heated to the vaporization point. The positioning of the coils may be performed as part of the initial installation of the system. Accordingly, this step is shown in dashed lines since it may not be performed repeatedly or on an ongoing basis as are one or more of the other steps. Thus, heating is achieved using a clean heat transfer medium avoiding the problem of build-up of contaminants which may occur in cases where flue-gas, with containments resulting from the combustion process included therein, is used for heating purposes.

In step 606, the vaporized ammonia is injected into a flue gas stream. In some embodiments, prior to injection, the vaporized ammonia is mixed with the heat transfer media, e.g., air, and diluted prior to injection step 606. In step 607, which occurs on an ongoing or periodic basis, the flue gas stream is monitored for one or more of flow rate, temperature, and concentration of nitrogen oxides ($NO_x$). Steps 606 and 607 may be performed in parallel. In step 608, the amount of vaporized ammonia injected into the flue gas is controlled in response to the results of monitoring step 607. For instance, if the flue gas stream flow increases, the injected amount of vaporized ammonia might also be increased. If the temperature of the flue gas decreases, the amount of ammonia vapor and/or temperature of the ammonia vapor injected could be controlled accordingly (depending on the situation, it might be advantageous to increase the flow of vaporized ammonia if the catalytic conversion process would be less efficient at the new flue gas temperature, or might be decreased if the conversion process would be more efficient at the new flue gas temperature). If the quantity of $NO_x$ in the flue gas increases, more vaporized ammonia could be injected into the flue gas stream. Other similar control mechanisms would be obvious to those skilled in the art.

Various steps and/or modules described herein may be implemented using software implemented on one or more processors. Accordingly, modules may be interpreted as being hardware, software, or a combination of hardware and software. For example, control module 114 may be implemented as a computer based control system operating under the control of one or more software instructions.

Numerous additional variations on the methods and apparatus of the present invention described above will be apparent to those skilled in the art in view of the above description of the invention. Such variations are to be considered within the scope of the invention.

What is claimed is:

1. A method for vaporizing a fluid and injecting the vaporized fluid into a flue gas stream, the method comprising:

causing a heated non-flue gas fluid heat transfer medium to be in contact with a first sealed coil containing a fluid to be vaporized, and after the fluid has vaporized, injecting the vaporized fluid into a flue gas stream.

2. The method of claim 1, wherein said non-flue gas fluid heat transfer medium is a gas supplied by a non-flue gas source.

3. The method of claim 2, wherein said non-flue gas fluid heat transfer medium is air and wherein the fluid to be vaporized is ammonia.

4. The method of claim 3, wherein the non-flue gas fluid heat transfer medium is heated by the further step of:

causing a second sealed coil containing a heated second fluid to be in contact with the non-flue gas fluid heat transfer medium.

5. The method of claim 4, wherein said heated second fluid is water.

6. The method of claim 1, comprising the further steps of injecting the fluid to be vaporized into a first end of said first sealed coil and extracting said vaporized fluid from a second end of said first sealed coil.

7. The method of claim 1, comprising the further step of causing said heated non-flue gas fluid heat transfer medium to flow over the first sealed coil.

8. The method of claim 5, further comprising the step of causing the water to flow through the second sealed coil.

9. The method of claim 5, further comprising the steps of:

monitoring the flue gas stream, and controlling the amount of the vaporized fluid injected into the flue gas stream in response to said monitoring of the flue gas stream.

10. A fluid vaporization and injection assembly for generating a vapor to be injected into a flue gas stream, the assembly comprising:

a fluid vaporization unit including:

an input for receiving a non-flue gas fluid heat transfer medium, a first sealed coil having an input for receiving a fluid to be vaporized, and an output, said first sealed coil being positioned to absorb heat from said non-flue gas fluid heat transfer medium as it passes through the fluid vaporization unit; and an injection unit coupled to the output of said vaporization unit for injecting a vaporized fluid into the flue gas stream.

11. The assembly of claim 10, wherein said non-flue gas fluid heat transfer medium is a gas supplied by a non-flue gas source.

12. The assembly of claim 11, wherein said non-flue gas fluid heat transfer medium is air and wherein the fluid to be vaporized is ammonia.

13. The assembly of claim 10, wherein said fluid vaporization unit further comprises a second sealed coil having an input and an output through which a heated second fluid is to be passed, said second sealed coil being arranged to transfer heat from said heated second fluid to said non-flue gas fluid heat transfer medium.

14. The assembly of claim 13, wherein said heated second fluid is water.

15. The assembly of claim 12, wherein said fluid vaporization unit further comprises an electric heating element for heating said non-flue gas fluid heat transfer medium.

16. The assembly of claim 13, further comprising a housing for containing said non-flue gas fluid heat transfer medium as it passes from said input of said fluid vaporization unit to an output of said fluid vaporization unit, said second coil being arranged in said containment structure upstream of said first sealed coil.

17. The assembly of claim 16, wherein the injection unit includes a vapor injection control module for controlling the amount of vapor injected into the flue gas stream.

18. The assembly of claim 17, wherein said injection unit further includes a pipe with an opening terminating in a flue stack for injecting the vaporized fluid into the flue gas stream passing through said flue stack; and a control valve coupled to the control module for controlling the amount of vapor allowed to pass through said pipe under the control of the control module.

19. The assembly of claim 18, further comprising a flue stack sensor positioned in said flue stack and being coupled to said control module for sensing at least one flue gas stream condition.

20. Assembly of 19, wherein said sensor is one of a flow sensor and a temperature sensor.

21. Assembly of 19, wherein said sensor determines the concentration of nitrogen oxides in the flue gas stream.

22. The assembly of claim 13, further comprising a boiler being coupled to said second sealed coil.

23. The method of claim 9, wherein the step of monitoring further comprises determining one of: the concentration of nitrogen oxides in the flue gas stream, the rate of flow of the flue gas stream, and the temperature of the flue gas stream.

24. A fluid vaporization assembly for generating a vapor to be injected into a flue gas stream, the assembly comprising:

a housing including an input for receiving a non-flue gas fluid heat transfer medium;

a first sealed coil having an input and an output through which a heated second fluid is to be passed, said first sealed coil being positioned in said housing to transfer heat from said heated second fluid to said non-flue gas fluid heat transfer medium; and a second sealed coil having an input for receiving a fluid to be vaporized, and an output, said second sealed coil being positioned in said housing to absorb heat from said non-flue gas fluid heat transfer medium as it passes through said housing to thereby heat said fluid to be vaporized prior to it passing through said output.

25. The method of claim 24, further comprising:

an injection unit coupled to the output of said vaporization unit for injecting a vaporized fluid into the flue gas stream.

26. The assembly of claim 25, wherein said non-flue gas fluid heat transfer medium is air and wherein the fluid to be vaporized is ammonia.

27. The assembly of claim 25. wherein said heated second fluid is water.

28. The assembly of claim 25, further comprising:

a blower for forcing said non-flue gas heat transfer medium through said housing; and a control module for controlling the rate of said blower to vary the amount of heat transferred to said fluid to be vaporized as a function of at least one sensed value.

* * * * *